United States Patent [19]

Widerby et al.

[11] 4,320,695

[45] Mar. 23, 1982

[54] AIR DIFFUSER

[75] Inventors: Lennart Widerby; Birger Eriksson, both of Jönköping, Sweden

[73] Assignee: AB Svenska Flaktfabriken, Nacka, Sweden

[21] Appl. No.: 148,241

[22] Filed: May 9, 1980

[30] Foreign Application Priority Data

May 10, 1979 [SE] Sweden ..... 7904100

[51] Int. Cl.[3] ..... F24F 13/08

[52] U.S. Cl. ..... 98/40 N; 98/40 B; 239/455

[58] Field of Search ..... 98/40 R, 40 B, 40 D, 98/40 V, 40 N, 36; 239/451, 455

[56] References Cited

U.S. PATENT DOCUMENTS

| | | | |
|---|---|---|---|
| 777,053 | 12/1904 | Wilson | 239/451 |
| 1,272,031 | 7/1918 | Gohmert | 239/455 |
| 1,564,963 | 12/1925 | Kirgan | 239/451 X |
| 2,852,311 | 9/1958 | Alexeff | 98/40 N X |
| 3,608,468 | 9/1971 | McClurkin | 98/40 N X |
| 4,078,476 | 3/1978 | Widerby | 98/41 AV |
| 4,109,564 | 8/1978 | Widerby | 98/40 N |
| 4,206,876 | 6/1980 | Koch | 239/455 |

FOREIGN PATENT DOCUMENTS

| | | | |
|---|---|---|---|
| 13934 | of 1897 | United Kingdom | 239/451 |

*Primary Examiner*—Albert J. Makay
*Assistant Examiner*—Harold Joyce
*Attorney, Agent, or Firm*—Dann, Dorfman, Herrell and Skillman

[57] ABSTRACT

An air diffuser for spreading and feeding out an exact amount of conditioned air, comprising an inlet 3 and a stationary hood part 6 connected thereto cooperating with an adjustable hood part 7 for variation of a spreading or feeding gap for the conditioned air. A spring 14 is provided between both hood parts, which are kept at a selected spacing by means of an adjusting screw. Said screw extends through the adjustable hood part via an opening with large allowance, so that the adjustable hood part can be tilted such, that a certain enlargement of the spreading gap on the one side is corresponded proportionally by a corresponding diminution on the diagonally-opposite side. Adjusting the screw changes the total flow through the gap. Tilting the hood part changes the distribution of the air without changing the total flow.

13 Claims, 4 Drawing Figures

AIR DIFFUSER

The present invention concerns an air diffuser for distributing conditioned air into a room of a centrally airconditioned building. In air conditioning rooms, spray or spreading nozzles or diffusers are often used as outlets of a channel or duct supplying conditioning air. The purpose of these diffusers is to spread out in a suitable way the air supplied to said rooms and/or to feed out an exactly predetermined amount, which latter function is very essential in larger systems, where relatively high pressures prevail in order to supply desired quantities to all places of consumption.

The above-mentioned purposes are already fulfilled by certain air diffusers, which both spread out the air rapidly into a room, and which feed out the exact predetermined amount of air, which can be adjusted by special means of various kinds.

Accordingly, in principle it is possible to find a solution for each spreading and feeding demand, but there are problems as to using one and the same air diffuser for various kinds of spreading and feeding. Furthermore, it is difficult to find a diffuser which is easy, cheap and fast to produce and to mount as well as to demount, due to lack of a simple, cheap and completely reliable adjusting means for obtaining both the desired spreading and the desired amount of feeding.

One purpose with the present invention accordingly is to overcome, and as far as possible to eliminate, the drawbacks of previously-known air diffusers in the afore-mentioned aspects. A further object of the invention is to provide general improvement of techniques in this field and to produce an air diffuser which is advantageous in various respects.

These objects are achieved according to the present invention by an air diffuser of the initially mentioned kind, which is constructed to provide independent adjustment of the spreading pattern or distribution, and the amount of the supplied air. Tests with a prototype of such an air diffuser have shown, that an infinitely variable adjustment of the amount of supplied air is possible by fast and simple adjustment of a simple adjusting screw or the like. Furthermore one can rapidly and infinitely vary the spreading pattern, so as to be directed more into a certain direction and less in another one.

Further characteristics and advantages of the invention are revealed by the following specification with reference to the accompanying drawings, in which.

Figure 1:
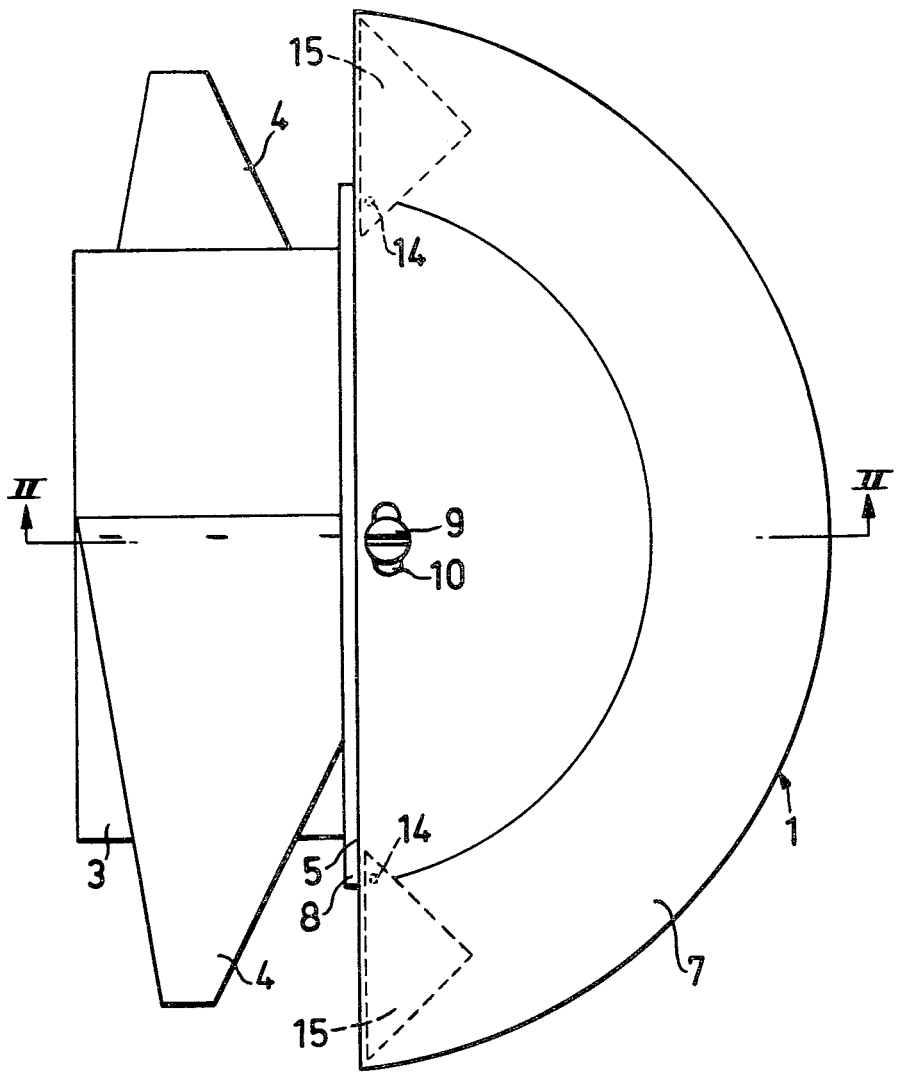
FIG. 1 shows a preferred embodiment of an air diffuser according to the invention in a side view.
Figure 2:
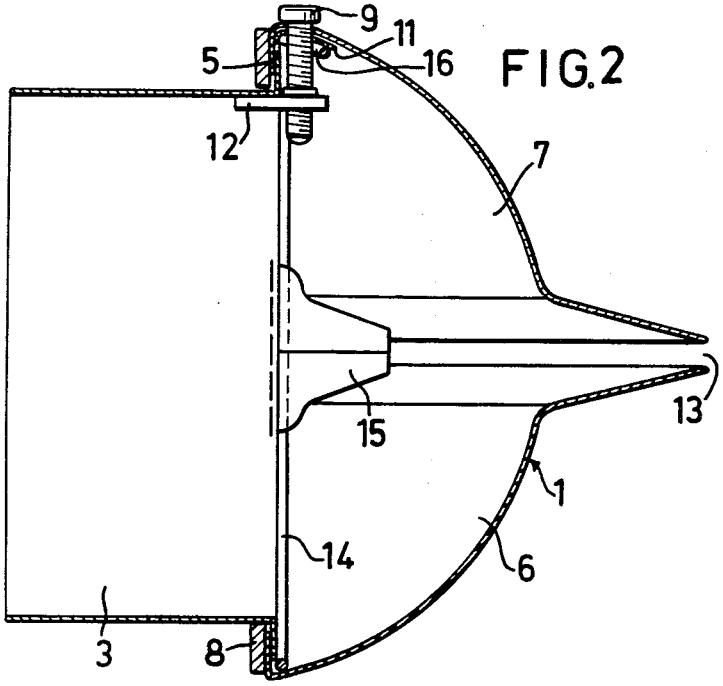
FIG. 2 shows the same diffuser in a sectional view along line II—II in FIG. 1.
Figure 3:
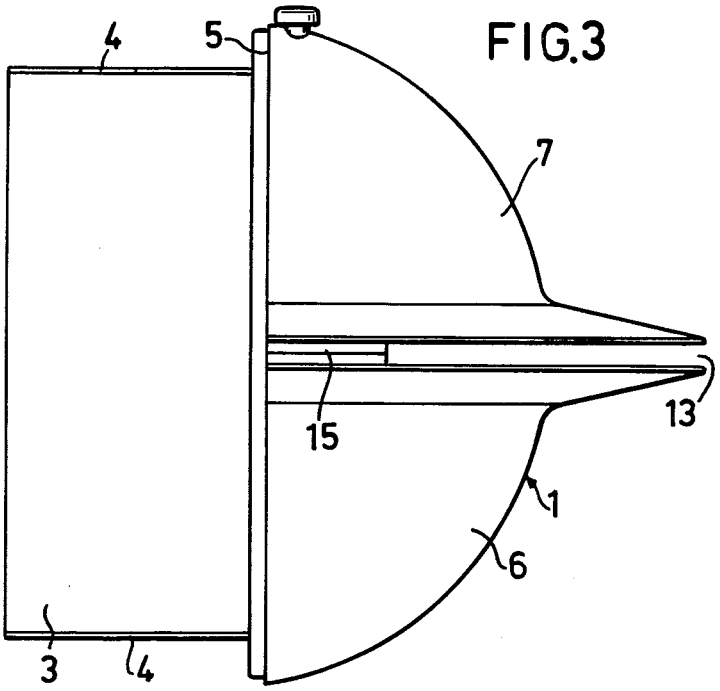
FIG. 3 shows the same diffuser seen from above or below in FIG. 1.
Figure 4:
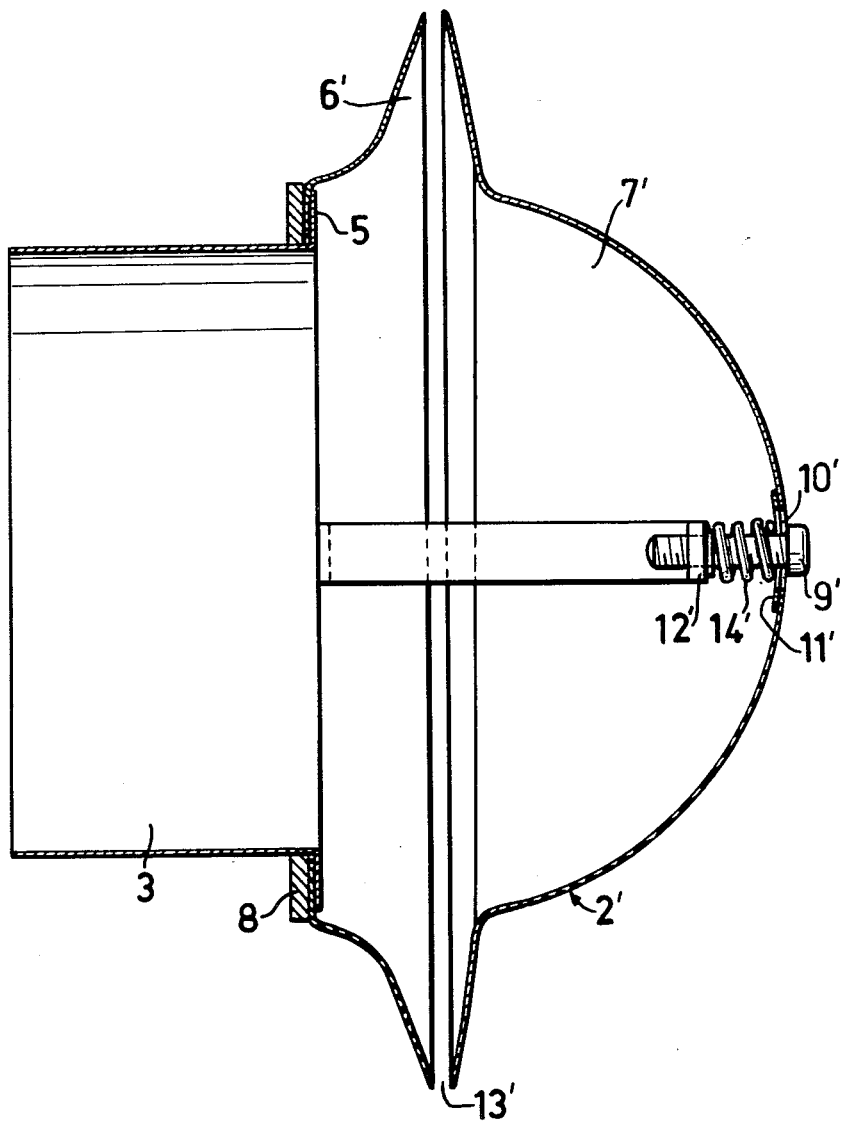
FIG. 4 shows a modified embodiment of an air diffuser according to the invention in cross-section.

Of the two air diffuser embodiments shown, the air diffuser 1 as shown in FIGS. 1–3 is preferred for wall mounting, meanwhile the air diffuser 2′ according to FIG. 4 preferably is intended for ceiling mounting.

Both air diffusers comprise preferably a cylindric inlet 3 being a metallic tube. On the outside of this tube, arresting wings 4 can be provided for anchoring the diffuser inlet in a channel or duct opening (not shown) for supplying conditioning air.

The one end of the inlet 3 is flanged to provide a surrounding base 5. According to FIG. 4, the base 5 is surrounded by an annular disk-like stationary hood part 6′ and is connected to this e.g. by welding or gluing about its entire periphery.

According to FIGS. 1–3 a stationary hood part 6 comprises a doomed generally quarter-spherical arcuate hollow body member surrounding only approximately half or 180° of the base periphery, in which area the same attachment can be applied as according to FIG. 4.

Cooperating with this stationary hood part 6 in FIGS. 1–3 there is a mirror-symmetrical arcuate hollow body member forming an adjustable hood part or half 7, which in an almost identical way surrounds the remaining part of base 5, but without being rigidly secured thereto.

In FIG. 4, an adjustable hood part 7′ comprises an arcuate body member shaped like a helmet or a hemisphere with flattened edges pointing out like a rim or lip and coresponding mirror-symmetrically to a similar projecting rim or lip of the stationary hood part 6′.

In all embodiments, between the stationary hood part and the adjustable one, a spreading or diffusing gap is left in a plane which extends from the opening of the inlet 3. The gap 13 according to FIG. 1–3 extends along the axis of the opening over somewhat less than a half-circle, while the gap 13′ in FIG. 4 extends transversely to the axis of the opening for a full 360° and is thus endless.

To the inlet 3 and/or the stationary hood part 6 of FIGS. 1–3, there is rigidly connected a support or the like 12, which has a threaded bore (not shown) for retaining an adjusting screw 9. This screw extends perpendicular to the plane of the gap with its head to the outside of the adjustable hood part 7. Its threaded shank passes through an adjusting opening 10 (see FIG. 1) in the adjustable hood part 7, which opening surrounds said screw with substantial allowance, so that the adjustable hood part can be tilted or displaced substantially at right angle to the adjusting screw 9. According to FIG. 4, a support 12′ extends into the opening of the duct 3 from the flange 5 and has a threaded bore disposed on the central axis of the duct 3. An adjusting screw 9′ extends through the movable hood part 7 by way of an opening 10′ which is circular, so that the adjustable hood part 7 may be tilted in all directions, which are at right angle to the adjusting screw. According to FIGS. 1–3, a tilting is only meaningful in a direction towards the ends of both hood parts and therefore, the opening 10 is shaped as an oblong groove and is sufficient to allow this adjustment (FIG. 1). In all cases, however, rentention washers 11 and 11′ are provided on the inside and/or outside of the adjusting openings 10 and 10′.

The adjusting screw is provided for holding the adjustable hood part in position in relation to the stationary hood part, and the head of said screw—possibly supported by the retention washer—permits an infinitely variable adjustment of the width of said spreading gap between closed and open limit positions by corresponding screwing in or out of said screw. This adjustment of the spreading gap varies the amount of flow without changing the tilt of the adjustable hood part, and the adjustment of spreading accomplished by the tilt.

In order to hold the adjustable hood part 7 and 7′ in position away from the stationary ones, there are springs 14 and 14′, which according to FIG. 4 is a coil spring 14′ surrounding the screw 9′.

In the embodiment according to FIGS. 1–3, a screw spring or a helical spring can be used, but use of a special spring 14 has proved to render greatest stability and a desirable increased area of friction. Simultaneously, such a special spring can be made fast and by simple means and is accordingly an economic product, which furthermore can be mounted and demounted in a fast and simple way.

According to a preferred embodiment, which is shown in FIG. 2, this special spring 14 is constituted by a loop spring extending over more than 180° of the periphery of the flange 5 in the groove-like receptacle formed in the corner between the flange 5 and both hood parts 6 and 7. The extension is, however, preferably less than 360°, so that the spring ends do not interfere with each other or with the other parts. Said loop spring is in an unstressed state larger than said surrounding groove-like receptacle, so that it will have to be compressed somewhat when inserted and snaps into its position under tension and with friction. For safeguarding a certain position of said spring, so that the spring ends cannot come into a position obstructing said spreading gap 13, said spring is preferably provided with a central bend 16 surrounding the adjusting screw 9, so that this spring is always kept in position by said adjusting screw.

The hood parts 6 and 7 have inturned flanges confronting the flange 5. When assembling the air diffuser, one has only to insert said adjusting screw into the adjustable hood part and to insert the spring 14 in such a way, that its bend 16 surrounds said screw, whereupon the adjustable hood part is brought in a position according to FIGS. 2 and 3 with the flanges of said adjustable hood part engaging between said base 5 and said seal 8. Meanwhile said spring 14 with its free ends simultaneously snaps into said receptacle formed in the corner between said base and the stationary hood part, whereafter the adjusting screw 9 is screwed into the support 12, until the desired width of said gap is achieved.

In order to direct a greater flow of air into one side direction compared to another one, one has only in a corresponding way to tilt the adjustable hood part 7 mainly at right angle in relation to the adjusting screw, until the desired gap widths are achieved in the areas of both gap ends. Adjustment by tilting does not substantially affect the amount of flow, since an increase in the gap at one end effects a decrease in the gap at the diametrically opposite end. Simultaneously with this movement, the spring 14 can be moved correspondingly against the friction exerted by said spring, which friction serves to keep the adjustable hood part in the adjusted position upon said position adjustment. A certain friction is, however, exerted already by cooperation between said screw head and said spring, which also applies particularly to FIG. 4, where the cooperation is the only source of friction and accordingly the only retaining power for the adjusted position.

If in connection with the embodiment of FIGS. 1–3 a shielding of the diametrically opposite ends of said spreading gap 13 is desired, this is preferably achieved by means of shielding pads, which can be made of foamed plastic or the like, and which are preferably slid on to the loop-shaped spring 14. Said pads can be in the form of a right triangle with the one triangle side being slid on to said spring 14, while the triangle base is in parallel relation to the outer ends of the hood parts. Thanks to their elasticity, said pads adopt easily to various adjusting movements and seal reliably in all positions.

The embodiments as described above and shown in the drawings are to be regarded only as non-limiting examples, which can be modified and completed in any way within the scope of the invention and following claims. Accordingly, one can, of course, give greater width to the adjustment opening 10 according to FIGS. 1–3, so that tilting towards the center of said spreading gap is possible, although such an adjustment generally won't be needed.

A great advantage of all these embodiments resides in that said tilting movement for infinite variation of the direction of air flow does not bring about any change of total flow, as flow diminishing on the one side proportionally is corresponded by a flow increase on the other side. In such a way, by tilting the adjustable hood part, one can achieve any desired direction of flow, so that such an adjustment can be performed even by laymen, which is very useful for larger ventilation or air conditioning systems, where otherwise unbalance easy can arise due to wrong changes effected in the flow of air.

What is claimed is:

1. An air diffuser for distributing and feeding out a selected amount of supplied conditioning air, comprising an inlet opening and hood parts connected thereto, said parts being spaced apart to provide an elongated spreading gap in a plane communicating with said inlet opening, one of said hood parts being displaceable relative to the other for adjustably varying said spreading gap, an adjusting screw to relatively displace said hood parts in a direction perpendicular to the plane of said gap between closed and open limit positions, spring means to keep said hood parts in a position selected by said screw to provide a gap width feeding out said selected amount of air, said screw means including a threaded support which is stationary relative to one of said hood parts, the other of a said hood parts having an adjustment opening receiving the shank of said screw with sufficient clearance for enabling a tilting displacement of said other part substantially at right angles to the adjusting screw to vary the distribution of the selected amount of air along the length of said gap.

2. An air diffuser according to claim 1 wherein said other hood part comprises a hollow arcuate body member having a generally spherical configuration, said adjustment opening being disposed in the spherical portion of said body member to afford tilting of said member when displaced at right angles to the adjusting screw.

3. An air diffuser according to claim 2 wherein said adjusting screw has a head spaced from said threaded support, said hood part opening being engaged on said screw between said head and said support, said spring means being positioned between said support and said opening to bias said arcuate body member toward said head to cause said arcuate body member to be displaced perpendicular to said plane with said head upon threaded adjustment of said screw in either direction in said support.

4. An air diffuser according to claim 3 wherein said other hood part has a projecting rim, and said one part has a rim cooperating with said projecting rim to define said spreading gap therebetween.

5. An air diffuser according to claim 4 wherein said other hood part is semi-spherical, said spreading gap is endless, said threaded support and adjusting screw are coaxial with the central axis of said endless spreading gap, and said spring means comprises a helical spring mounted on said screw between said support and said opening and washer means to afford displacement of said arcuate body member relative to said spring and screw.

6. An air diffuser according to claim 4 wherein said hood parts are generally quarter-spherical and define between them a circular spreading gap extending approximately 180° of a circle, the plane of said gap extending along the central axis of said opening, said threaded support and adjusting screw having the adjusting axis disposed radial to said central axis and aligned with the center of said circular spreading gap.

7. An air diffuser according to claim 6 wherein said hood parts are symmetrical, one being a mirror image of the other, one of said parts being fixedly mounted in said inlet opening and the other being adjustably mounted by said threaded support and screw.

8. An air diffuser according to claim 3 wherein said arcuate body member has an inturned flange forming a groove-like receptacle in the corner between said flange and said arcuate body member, said spring comprising a loop mounted in said receptacle tending to displace body member away from the plane of the spreading gap.

9. An air diffuser according to claim 8 wherein said spring has a bend portion surrounding said adjusting screw to keep said spring from displacement along the groove-like receptacle.

10. An air diffuser according to claim 8 including shielding pads mounted on said spring loop to cover the spreading gap at the diametrically opposite sides of said inlet opening.

11. An air diffuser according to claim 10 wherein said pads comprise triangles having one side carried on said spring loop and extending outwardly along said spreading gap to cover the same at diametrically opposite sides of said inlet opening.

12. An air diffuser according to claim 2 wherein said adjustment opening is oblong with an elongated axis extending diametrically of said hollow spherical body member to afford tilting of said body member along said elongated axis.

13. An air diffuser according to claim 2 wherein said adjustment opening is circular so that the body member may be tilted in all directions which are at right angles to said adjusting screw.

* * * * *